US007178209B1

(12) United States Patent
Radziewicz

(10) Patent No.: US 7,178,209 B1
(45) Date of Patent: Feb. 20, 2007

(54) MOBILE CREMATION URN

(75) Inventor: Stephen J. Radziewicz, Fayetteville, NC (US)

(73) Assignee: Final Ride Products, Fayetteville, NC (US)

( * ) Notice: Subject to any disclaimer, the term of this patent is extended or adjusted under 35 U.S.C. 154(b) by 0 days.

(21) Appl. No.: 11/302,562

(22) Filed: Dec. 13, 2005

(51) Int. Cl.
*A61G 17/00* (2006.01)

(52) U.S. Cl. ..... 27/1

(58) Field of Classification Search ..... 27/1, 27/35; D99/5
See application file for complete search history.

(56) References Cited

U.S. PATENT DOCUMENTS 3,920,140 A 11/1975 Kiser
4,221,844 A * 9/1980 Hasenour ..... 428/623
4,607,417 A 8/1986 Hancovsky
5,005,784 A * 4/1991 Harden ..... 244/136
5,158,174 A 10/1992 Hereford
5,172,457 A * 12/1992 Allen et al. ..... 27/1
5,299,720 A 4/1994 Koch, III
5,393,253 A 2/1995 Humble et al.
5,485,661 A 1/1996 McClure
5,887,774 A 3/1999 Bethune
5,950,287 A 9/1999 Cacciatore et al.
6,092,707 A 7/2000 Bowes, Jr.
D437,250 S * 2/2001 Hull et al. ..... D11/82
6,254,152 B1 7/2001 Tillett
6,550,114 B1 4/2003 Reece
6,584,658 B2 7/2003 Robinson
6,629,321 B1 10/2003 Hunt et al.
6,729,247 B2 5/2004 Brown et al.
6,754,940 B1 6/2004 Boots
6,763,558 B1 7/2004 Mytych
6,785,938 B1 9/2004 Johansen, Jr.
6,988,299 B1 * 1/2006 Barrette et al. ..... 27/1
2004/0104255 A1 6/2004 Trautman
2005/0081561 A1 4/2005 Eggleston
2005/0125973 A1 * 6/2005 Hankel et al. ..... 27/1
2005/0194200 A1 9/2005 Larson

FOREIGN PATENT DOCUMENTS

CA 2311959 * 12/2001
WO WO 2004/000192 A1 12/2003

* cited by examiner

*Primary Examiner*—William L. Miller
(74) *Attorney, Agent, or Firm*—Coats & Bennett, P.L.L.C.

(57) ABSTRACT

A mobile cremation urn includes a container portion having a volume in which cremation ashes are stored and a mounting portion coupled to the container portion to secure the mobile cremation urn to a moving vehicle. The container portion may be elongated and the mounting portion may be oriented substantially parallel with the container portion or a longitudinal axis thereof. The mounting portion may include a mounting flange, mounting posts, or mounting apertures. A removable closing member may be attached to the container portion and may seal the ashes contained therein. The closing member may also include a locking feature. The container may be fabricated with a corrosion resistant coating. A distinguishing mark may be displayed on an exterior surface of the container.

23 Claims, 5 Drawing Sheets

MOBILE CREMATION URN

BACKGROUND

Cremation urns are containers that are used to hold the cremated remains of living beings. Cremation is an alternative to earth burial or entombment for the final disposition of the body of the deceased. It is a process by which the body is reduced to ashes by heat and fire. The remains may be placed in a cremation urn, which can be buried much like a full size casket. Sometimes, friends and family of the deceased may scatter the ashes in a sentimental location. However, in many instances, the cremation ashes may be memorialized in a home, a columbarium, a mausoleum, or other fixed location where the urn is displayed.

Keepsake urns are another type of urn designed for those wishing to memorialize the deceased. Jewelry is one type of keepsake urn that allows loved-ones to carry a portion of the cremated remains as a memento or to give a small amount of the remains to others. Jewelry and these types of keepsake urns are portable, which offers a different way to memorialize the deceased. However, these types of keepsake urns are discrete, delicate items often noticeable and sentimental mostly to those wearing the item. Others who see the keepsake may not understand or appreciate its significance.

It should always be remembered that memorialization serves as a tribute to a life lived and provides a focal point for remembrance of the deceased. For some people, memorialization that contemplates a fixed display or a piece of jewelry worn on a person does not reflect the true nature and spirit of the deceased. In some cases, the deceased may have been a part of an organization having a large following or that is well known or well respected. Also, the deceased may have been an avid outdoorsman, traveler, or motorcyclist who is not representatively memorialized through an urn that is displayed in a fixed manner or worn on a person's body. Conventional urns do not appear to address the desire for persons, friends, and families to transport cremation ashes in a manner similar to they way the deceased lived their lives.

SUMMARY

Embodiments of the present invention are directed to a cremation urn that may be secured to moving vehicles. The urn may include a container portion having a volume in which cremation ashes are stored and a mounting portion coupled to the container portion to secure the urn to a moving vehicle. For instance, the urn may be secured to a motorcycle or to the exterior of other land-going, water-going, or air-going vehicles. The container portion may be elongated and the mounting portion may be oriented substantially parallel with the container portion or a longitudinal axis thereof. The mounting portion may include a mounting flange, mounting posts, or mounting apertures. In one embodiment, the mounting apertures permit installation at or near the forks or triple-tree of a motorcycle. A closing member may be attached to the container portion and may seal the ashes contained therein. The closing member may also include a locking feature to keep the closing member from loosening. The container may be fabricated with a corrosion resistant coating. A distinguishing mark may be displayed on an exterior surface of the container.

DETAILED DESCRIPTION

Figure 1:
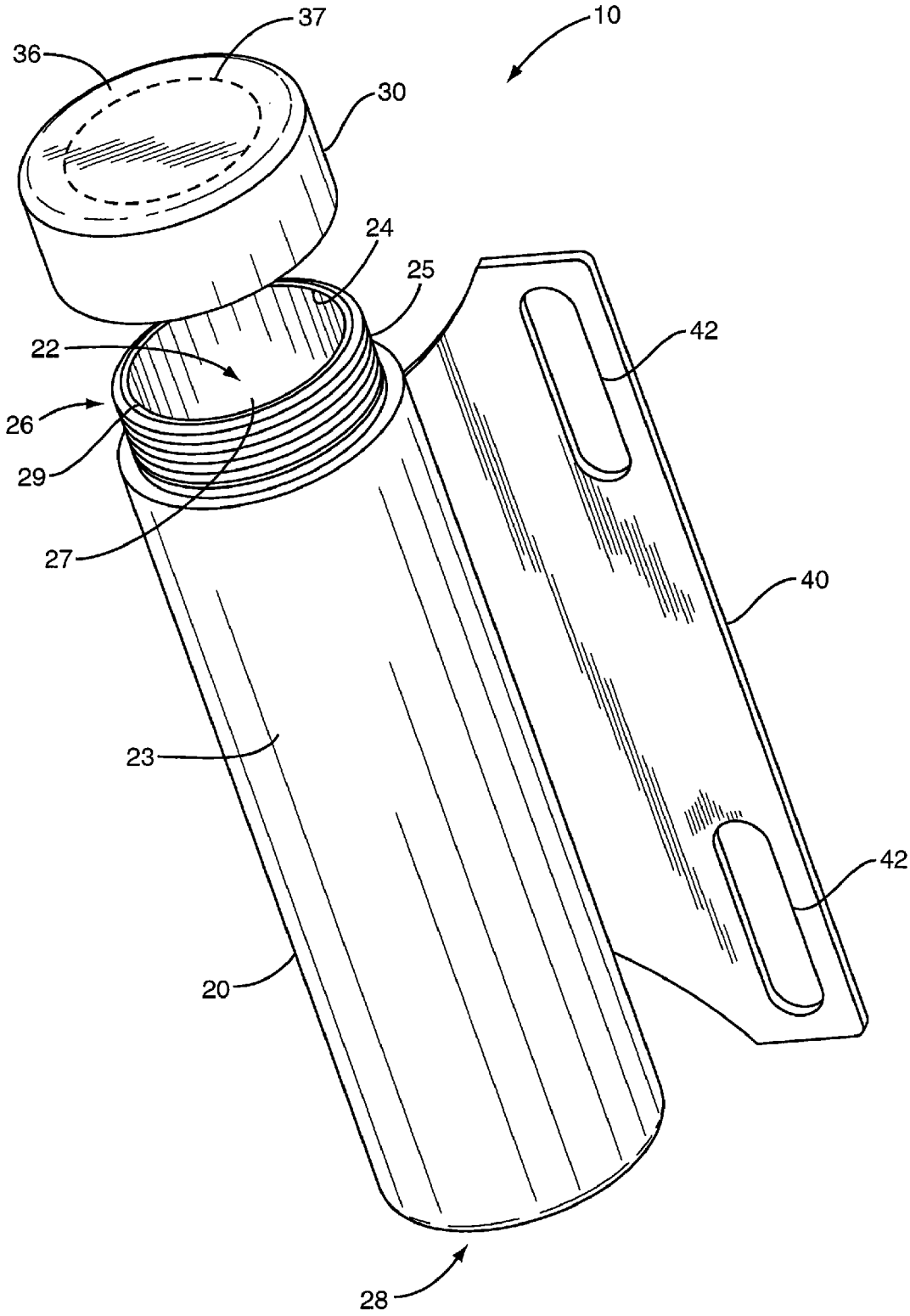
FIG. 1 is perspective view of a mobile cremation urn according to one embodiment.

The various embodiments disclosed herein are directed to a mobile cremation urn. A representative example of a mobile cremation urn 10 is generally illustrated in FIG. 1. This embodiment of the cremation urn 10, is generally comprised of a container portion 20 and a cap 30. The container portion 20 is generally cylindrical and includes a storage volume 22 formed at least partially by inner wall 27 and contained therein. The cylindrical shape of the container portion 20 may advantageously provide a large storage volume 22 in a low-profile shape. The storage volume 22 is accessible through an opening 24 disposed at a first end 26 of the container portion 20. In contrast, the opposite end 28 of the container portion 20 is closed or sealed. The exemplary cap 30 is substantially cylindrical similar to the exemplary container portion 20. The cap 30 mates to the first end 26 of the container 20. In the embodiment shown, the cap 30 screws onto male threads 25 disposed about the opening 24. Once installed, an outer surface 36 of the cap 30 abuts or nearly abuts the outermost end 29 of the container portion 20 to effectively enclose the storage volume 22. In one or more embodiments of the mobile cremation urn 10, the container portion 20, cap 30, or mounting portion 40 may be large enough to display a meaningful or distinguishing mark 37 such as an emblem, logo, insignia, decal, or engraving. For example, a displayed feature may be located on surface 36 of cap 30 or outer surface 23 of container portion 20.

The exemplary embodiment of the mobile cremation urn 10 further comprises a mounting portion 40. In the present embodiment, the mounting portion 40 is a substantially flat mounting flange extending laterally from an outer surface 23 of the container portion 20. In the present embodiment, the mounting portion 40 includes two mounting apertures 42. As shown, these mounting apertures may be slots, which provides some flexibility in mounting the mobile cremation urn 10. However, other mounting aperture shapes, such as round, oval, hex, and square holes may be implemented. The mobile cremation urn 10 may be secured to a vehicle such as a motorcycle by securing the mounting portion 40 to the vehicle using commercially available hardware. For example, some combination of screws, bolts, nuts, or wing-nuts may be used.

The container portion 20, the cap 30, and mounting portion 40 may be constructed of a corrosion resistant material such as aluminum alloy, titanium, chrome-molybdenum or stainless steels. Carbon steels may be appropriate as well, especially when coated with a corrosion resistant coating such as chrome. Other coatings, including for example anodized, oxide, and nickel coatings, may be suitable for different base materials. Furthermore, base materials other than metal may be used. Some examples may include carbon fiber, ABS, fiberglass and other durable resin materials. In general, an aesthetic coating may be appropriate, especially given the symbolic nature of the mobile cremation urn 10.

Figure 2:
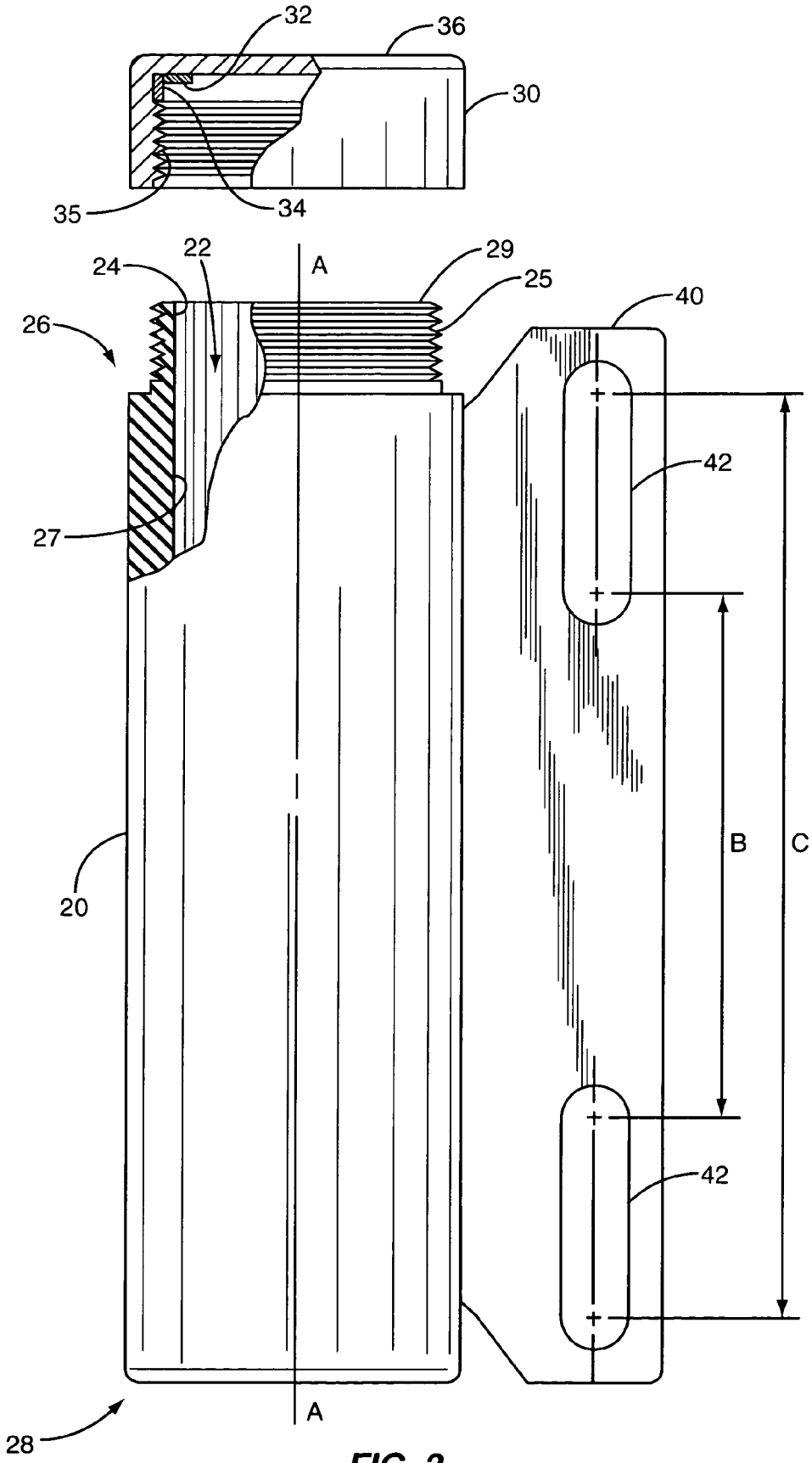
FIG. 2 is side view, including a partial section, of a mobile cremation urn according to one embodiment.

FIG. 2 shows a side view of the exemplary mobile cremation urn 10. FIG. 2 also provides a partial section view illustrating the internal construction of an exemplary container portion 20 and cap 30. The storage volume 22 is depicted as an interior volume surrounded by inner wall 27. The storage volume 22 may be closed by attaching the cap 30 to the container portion 20. As illustrated, the cap 30 comprises a complementary set of female threads 35 that mate with external threads 25 on the container portion. This allows the cap 30 to be screwed onto the container portion 20.

In certain embodiments, it may be desirable to environmentally seal the storage volume 22 once the cap 30 is installed. The mobile cremation urn 10 may be exposed to environmental elements, including moisture, wind, dust, dirt, pollen, chemicals, heat, cold, and the like. Accordingly, a seal member 32 may be used to keep contaminants out of the storage volume 22. By the same token, the seal member 32 may effectively contain the cremation ashes within the storage volume 22. Further, the seal member 32 should maintain its shape and composition after exposure to such elements.

In one embodiment, the seal member 32 may be formed from a rubber or Teflon® washer that may be compressed by the outermost end 29 of the container portion 20 when the cap 30 is installed. Other embodiments may incorporate o-rings, gaskets, or other types of seals fabricated from suitable materials such as fluorocarbon, cork, fiberglass, silicone, EPDM, Viton®, Durlon®, neoprene, or other polymers and elastomers.

The mobile cremation urn 10 may further comprise a locking feature 34 used to secure the cap 30 on the container portion 20. In one embodiment, the locking feature 34 may be implemented as a nylon thread insert similar to that used in commercially available lock nuts. The threads 25, 35 themselves may comprise locking features, such as Spiralock® threads. Other locking features may be implemented, including grooves, detents, protrusions, or other interlocking features in the cap 30 and container portion 20. In one embodiment, the cap 30 or other closing member may be welded in the attached position. In other embodiments, the cap 30 may be sealed and/or secured to the container portion through the use of a thread locker and/or thread sealer, such as those available under the Loctite® brand name. The use of a separate locking feature and thread sealer may obviate the need for features 32, 34 in the cap 30. In general, these types of locking features 34 should be sufficient to prevent the cap 30 from coming loose under vibration.

FIG. 2 also shows the spacing between the exemplary mounting apertures 42. In the present embodiment, the mounting apertures 42 allow mounting over a range of hardware spacing. That is, the mobile cremation urn 10 may be secured using hardware that is spaced apart within a range between the dimensions A and B shown in FIG. 2. Note also, that the apertures 42 and dimensions A, B are substantially aligned with the container portion 20. Also, the apertures 42 are aligned with a longitudinal axis A of the container portion 20. In one embodiment, dimensions A and B are approximately 3 and 8 inches, respectively. Larger or smaller sizes may be appropriate depending on the shape and volume of the container portion 20. For instance, the given dimensions A and B may be appropriate for a container portion that is approximately 2 inches in diameter and approximately 8 inches in length. These dimensions correspond approximately to a storage volume of about 25 cubic inches.

For reference, the cremated remains of an average size adult may weigh between about four to nine pounds and occupy about 200 cubic inches in volume or less. Thus, the exemplary mobile cremation urn 10 may be sized to hold a generous portion of the ashes produced during the cremation process. However, larger sizes may be created to hold most or all of the ashes produced during the cremation process. As a general rule, one cubic inch of urn volume may be needed for each pound of the body to be cremated. Thus, the size of the mobile cremation urn 10 may be adjusted upward or downward as desired.

Figure 3:
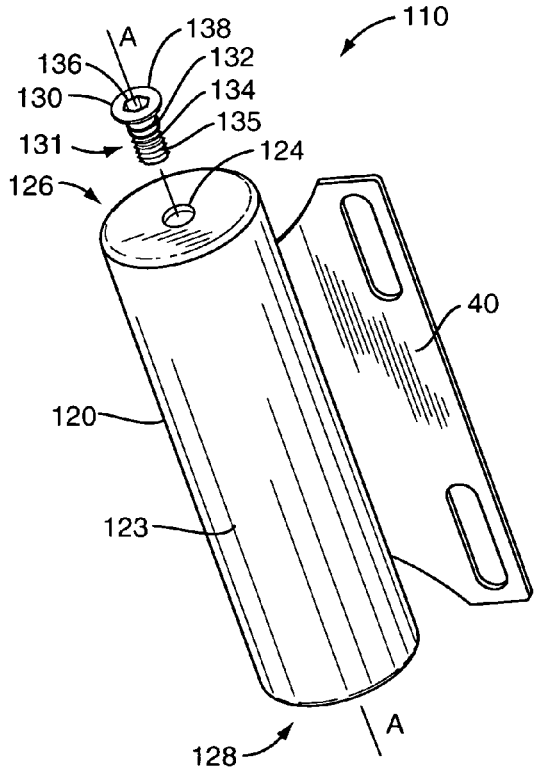
FIG. 3 is perspective view of a mobile cremation urn according to one embodiment.

Other means of closing the storage volume 22 may be implemented. For example, FIG. 3 shows an alternative embodiment of a mobile cremation urn 110, in which a plug 130 is used to close the container portion 120. In the embodiment shown, the plug 130 is inserted at a first end 126 of the container portion 120. However, the exemplary plug 130 may be positioned at other locations about the container portion 120, including for example, at the opposite end 128 or on a lateral side surface 123 of the container portion 120.

In the embodiment shown, the plug 130 comprises a head 138 in which a driving feature 136 is disposed. In the embodiment shown, the driving feature 136 is a hex recess drivable by a hex or Allen driver. Other exemplary driving features 136 may be shaped to accept different types of drivers, such as slotted, Phillips, star, Torx, square and triple square drivers. A stem portion 131 extends from the head portion 138 and is sized to fit within an aperture 124 in the container portion 120 to close the container portion 120. In the embodiment shown, the stem portion 131 comprises a seal member 132, a locking member 134, and threads 135 that may mate with corresponding threads (not shown) in aperture 124. The seal member 132 and locking member 134 may be configured as described above.

The cap 30 and plug 130 are two examples of devices that may be used to close the container portion 20, 120. Other types of closing members may be used as well. For instance, the closing members do not necessarily require threads as the illustrated items 30, 130 do. Thus, caps, plugs, and lids that snap on, clamp on, or partially twist on may be used. Some closing members may be pushed on or into the container portion 20, 120. The precise geometry of the closing member may be determined by the shape of the container portion 20, 120. Therefore, the illustrated embodiments are intended to provide examples of suitable closing members and should not be construed as limiting.

Figure 4:
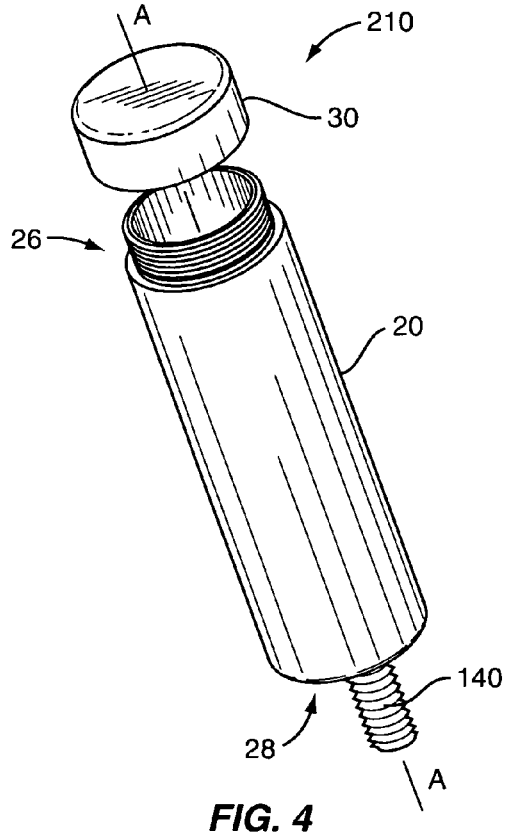
FIG. 4 is perspective view of a mobile cremation urn according to one embodiment.
Figure 5:
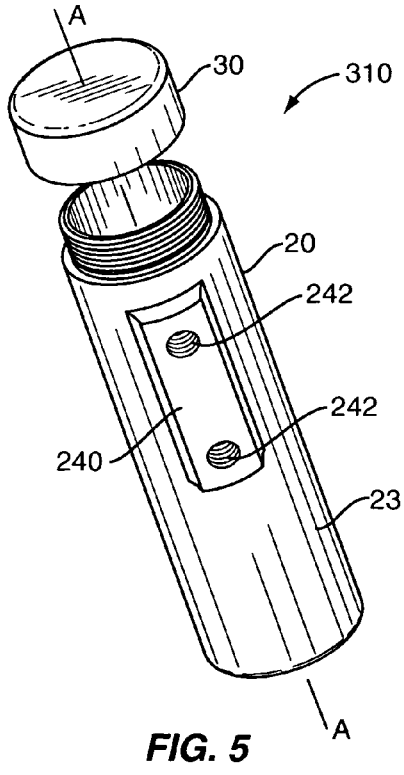
FIG. 5 is perspective view of a mobile cremation urn according to one embodiment.
Figure 6:
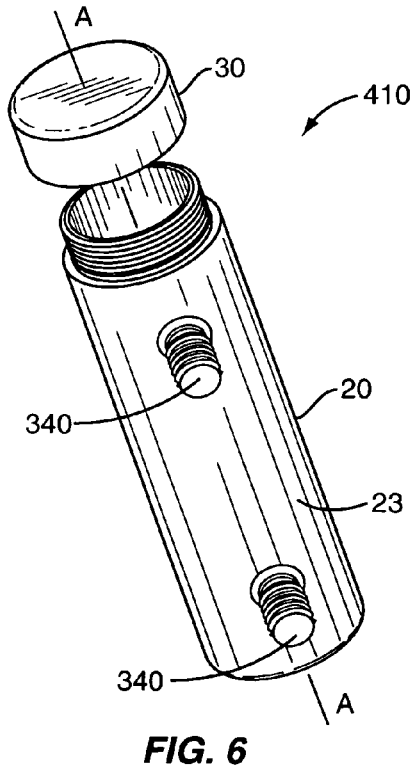
FIG. 6 is perspective view of a mobile cremation urn according to one embodiment.

In addition to the mounting portion 40 shown in FIGS. 1 and 2, other mounting configurations such as those illustrated in FIGS. 4, 5, and 6 may be used. FIG. 4 shows an alternative mobile cremation urn 210 in which an alternative mounting portion is embodied as a stud 140. The illustrated stud 140 extends outward from the end 28 of container portion 20 opposite to end 26 and cap 30. In one embodiment, the stud 140 is collinear with the longitudinal axis A of the container portion 20. In one embodiment, the stud 140 includes male threads and may be secured by a nut or other member having corresponding female threads (not shown). In an alternative embodiment, the stud 140 may protrude from the cap 30 at the opposite longitudinal end 26 of the container portion 120.

FIG. 5 shows an alternative mobile cremation urn 310 in which a raised boss portion 240 protrudes from an outer surface 23 of the container portion 20. A pair of mounting apertures 242 are disposed within the boss portion 240. The illustrated mounting apertures 242 are oriented in alignment with the longitudinal axis A of the container portion 20. However, in other embodiments, the apertures may be oriented in other patterns. This may include patterns of two or more apertures 242 oriented in triangle, rectilinear, or grid patterns aligned parallel to or perpendicular to axis A. In one or more embodiments, the mounting apertures 242 may be threaded to accept a screw or bolt (not shown).

FIG. 6 shows an alternative mobile cremation urn 410 in which a pair of studs 340 extend from an outer surface 23 of the container portion 20. The illustrated studs 340 are oriented in alignment with the longitudinal axis A of the container portion 20. However, in other embodiments, the studs 340 may be oriented in other patterns. This may include patterns of two or more studs 340 oriented in triangle, rectilinear, or grid patterns aligned parallel to or perpendicular to axis A. In one or more embodiments, the studs 340 may be threaded to accept a nut or other member having corresponding female threads (not shown).

Figure 7:
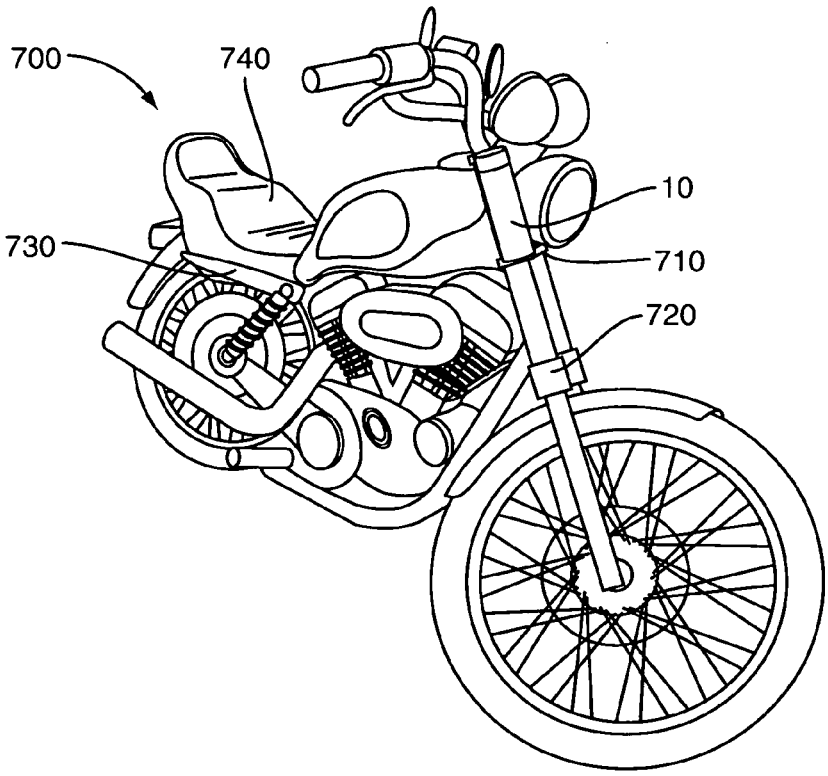
FIG. 7 illustrates a mobile cremation urn according to one embodiment secured to a motorcycle.

The various embodiments of the mobile cremation urn 10 (also 110, 210, 310, and 410) may all be secured to a moving object in a manner that appropriately, but respectfully memorializes a deceased party. One particular group of individuals for whom this type of memorialization is meaningful is motorcyclists. For instance, Harley-Davidson® motorcycles are known to have a large following, with a number of organized gatherings annually drawing tens of thousands of riders from all over the country. Riders of these and other motorcycles are known as individuals who value the freedom of the open road and open air. Accordingly, the mobile cremation urn 10 may be secured to a motorcycle 700 in a permanent or semi-permanent manner as shown in FIG. 7.

Conventional urns may be transported in a vehicle (e.g., a Hearse, or motorcycle sidecar) as part of a funeral precession to a final resting place. By comparison, the mobile cremation urn 10 may be secured to a vehicle such as motorcycle 700 and remain prominently displayed for an extended period of time. This does not preclude the use of the mobile cremation urn 10 as a memorialization during a funeral precession. For instance, the mobile cremation urn 10 may be secured to the lead motorcycle 700 in a long precession of other motorcycles to a burial site or other site where the ashes will be scattered.

The various mounting configurations described above may permit the mobile cremation urn 10 to be secured to a stock motorcycle 700 with little or no modification. Thus, the mobile cremation urn 10 may even be secured to a motorcycle 700 or other vehicle belonging to the deceased. As indicated above, one embodiment of the mobile cremation urn 10 included a plurality of mounting apertures 42. These apertures 42 may be spaced so that the mobile cremation urn 10 can be secured to locations on motorcycle 700 at which existing hardware is located. As an example, the motorcycle 700 shown in FIG. 7 includes a steering mechanism comprising a triple tree 710 and front forks 720. In one embodiment, the mounting apertures 42 are spaced to fit in hardware located adjacent to the triple tree. In addition, the mounting apertures 42 as well as the other mounting configurations shown in FIGS. 4–6, may be used to mount the mobile cremation urn 10 to other locations on the exemplary motorcycle 700. For instance, the mobile cremation urn 10 may be secured on the front forks 720 or perhaps on a rear fender 730 adjacent the seat 740.

Figure 8:
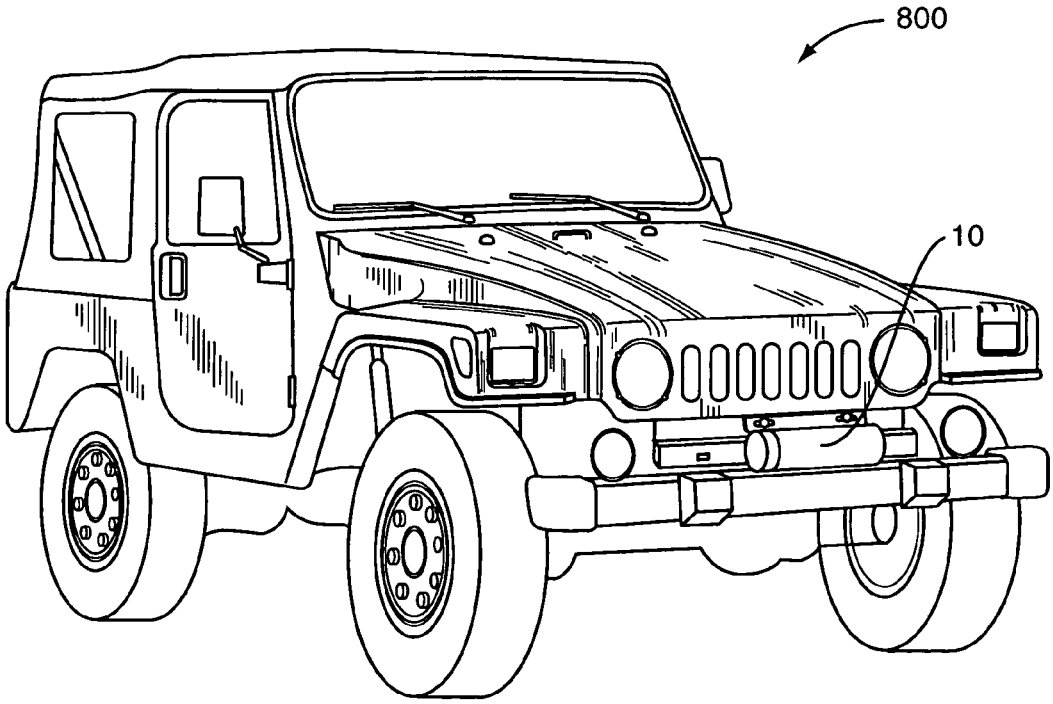
FIG. 8 illustrates a mobile cremation urn according to one embodiment secured to a land-going vehicle.
Figure 9:
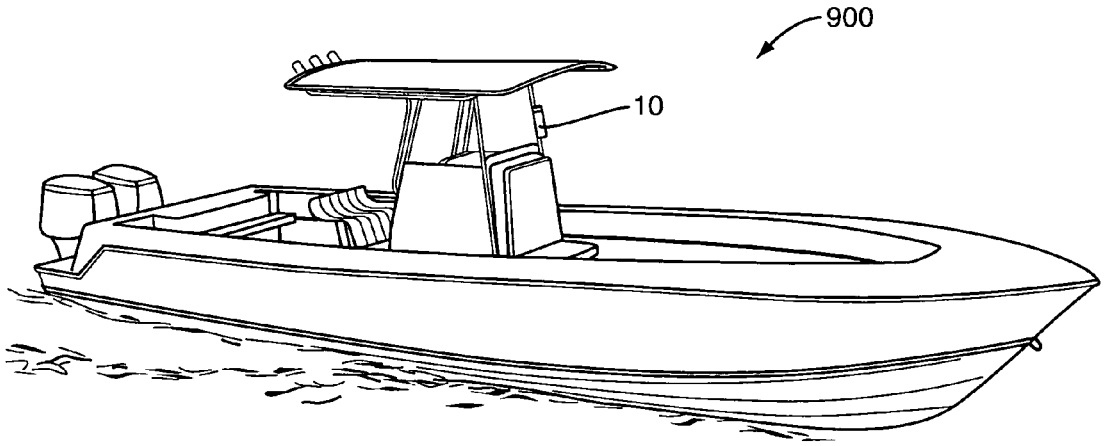
FIG. 9 illustrates a mobile cremation urn according to one embodiment secured to a water-going vehicle.
Figure 10:
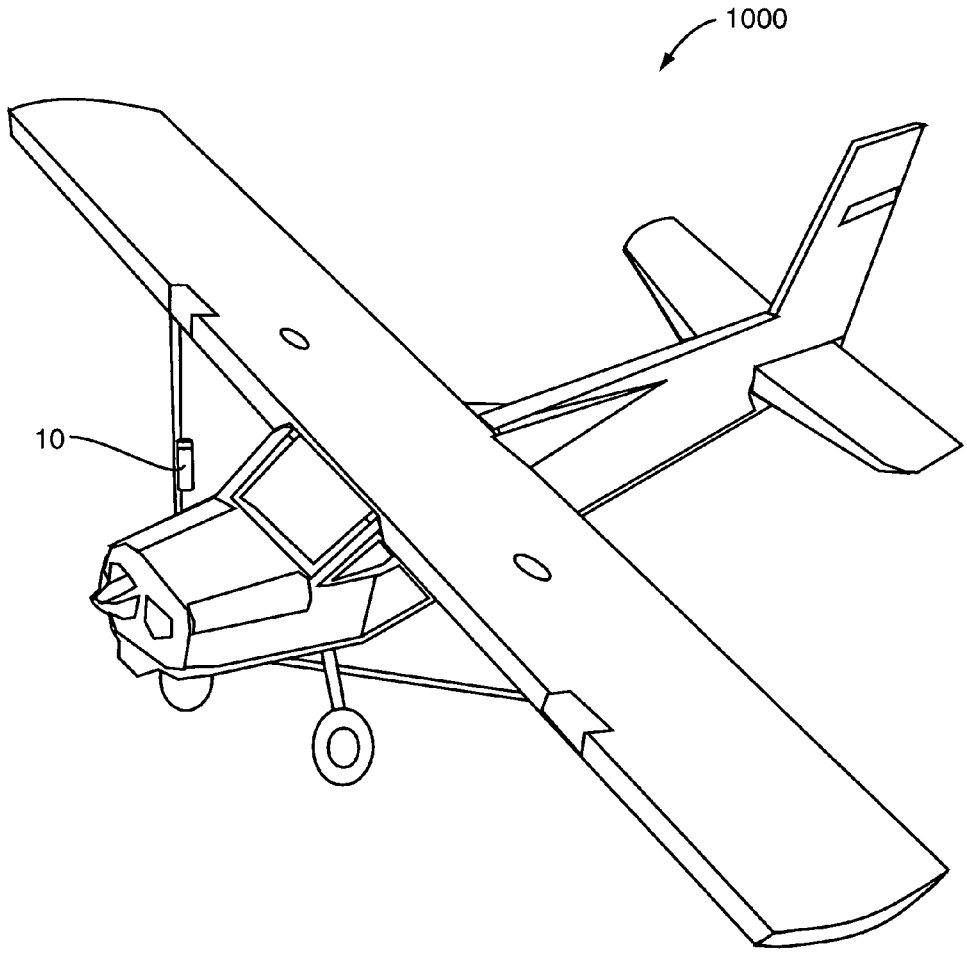
FIG. 10 illustrates a mobile cremation urn according to one embodiment secured to an air-going vehicle.

FIGS. 8, 9, and 10 shown the mobile cremation urn 10 secured to a variety of different vehicles, including land-going, water-going, and air-going vehicles. For example, FIG. 8 shows a mobile cremation urn 10 secured to a multipurpose vehicle. Examples of other types of land-going vehicles to which the mobile cremation urn 10 may be secured include golf carts, trucks, and service vehicles such as police cars and fire trucks. Similarly, FIG. 9 shows a mobile cremation urn 10 secured to a boat 900 while FIG. 10 shows a mobile cremation urn 10 secured to an airplane 1000. The mobile cremation urn 10 may also be mounted on other types of water-going and air-going vessels, including for example, jet skis, wave runners, airboats, gliders, helicopters, and other fixed wing and rotary wing aircraft.

The present invention may be carried out in other specific ways than those herein set forth without departing from the scope and essential characteristics of the invention. For example, the container portion 20 shown in the various embodiments is presented as substantially cylindrical. It should be understood that different shapes may be used and perhaps even desirable depending on the application. Examples of suitable shapes may include spherical, elliptical, cubic, rectangular, and teardrop shapes. Furthermore, while the mounting features in the various embodiments have been depicted as substantially fixed and attached to the container portion, other features such as adjustable clamps, friction locks, or four-bar locks may be used. Further, separable mounting portions are also contemplated. The present embodiments are, therefore, to be considered in all respects as illustrative and not restrictive, and all changes coming within the meaning and equivalency range of the appended claims are intended to be embraced therein.

What is claimed is:

1. A mobile cremation urn comprising:

an elongated container portion having a volume in which cremation ashes are stored, the container comprising an outer side surface extending in an elongate direction; and a mounting portion formed into the outer side surface of the container portion to secure the mobile cremation urn to a moving vehicle, wherein the mounting portion comprises a mounting flange having one or more mounting apertures.

2. The device of claim 1 wherein the vehicle is a motorcycle and the mounting apertures are spaced for coupling to a motorcycle tree.

3. The device of claim 1 wherein the one or more mounting apertures are aligned substantially parallel to the container.

4. The mobile cremation urn of claim 1 wherein the container portion has a chrome finish.

5. The mobile cremation urn of claim 1 wherein the container portion is environmentally sealed.

6. A mobile cremation urn comprising:

a storage container in which cremation ashes are stored, the storage container having an elongated body and including an outer side surface; and a mounting portion comprising a flange coupled to the storage container that is substantially parallel with the elongated body, the flange formed into the outer side surface and extending laterally from the outer side surface and comprising an aperture.

7. The mobile cremation urn of claim 6 wherein the flange is substantially flat.

8. The mobile cremation urn of claim of claim 6 wherein the aperture is slotted.

9. The mobile cremation urn of claim 6 further comprising a removable closing member to retain the cremation ashes within the storage container.

10. The mobile cremation urn of claim 9 wherein the removable closing member is a threaded member.

11. The mobile cremation urn of claim 9 wherein the removable closing member is a plug.

12. The mobile cremation urn of claim 9 wherein the removable closing member is a cap.

13. The mobile cremation urn of claim 6 wherein the storage container is substantially cylindrical.

14. A method of memorializing a deceased with a mobile cremation urn in which cremation ashes are stored, the method comprising:

providing a container in which to store the cremation ashes of the deceased; and providing a mounting feature on the container by which the container may be securely attached to a vehicle; and forming the mounting feature into a lateral surface of the container wherein the mounting feature comprises a mounting flange having one or more mounting apertures.

15. The method of claim 14 further comprising placing the cremation ashes of the deceased into the container.

16. The method of claim 15 further comprising sealing the cremation ashes of the deceased within the container.

17. The method of claim 14 further comprising securing the container to the vehicle.

18. The method of claim of claim 14 further comprising displaying a distinguishing mark on the exterior of the container.

19. A mobile cremation urn comprising:

a storage container in which cremation ashes are stored, the storage container having an elongated body including a longitudinal axis and including an outer side surface; and a flange formed into the outer side surface, the flange extending laterally from the outer side surface and also extending substantially parallel with the longitudinal axis, the flange including a first aperture extending through the flange in a direction substantially perpendicular to the longitudinal axis.

20. The mobile cremation urn of claim 19 further comprising a second aperture extending through the flange in the direction substantially perpendicular to the longitudinal axis, the second aperture positioned between about 3 and about 8 inches away from the first aperture.

21. The mobile cremation urn of claim 19 further comprising a second aperture extending through the flange in the direction substantially perpendicular to the longitudinal axis, the second aperture and the first aperture being aligned in a direction substantially parallel to the longitudinal axis.

22. The mobile cremation urn of claim 19 further comprising a removable plug to retain the cremation ashes within the storage container.

23. The mobile cremation urn of claim 19 further comprising a removable cap to retain the cremation ashes within the storage container.

* * * * *